United States Patent [19]

Haraguchi et al.

[11] Patent Number: 4,557,050

[45] Date of Patent: Dec. 10, 1985

[54] HAIR CUTTER

[75] Inventors: Hideaki Haraguchi; Shunichi Hata, both of Shiga, Japan

[73] Assignee: Matsushita Electric Works, Ltd., Osaka, Japan

[21] Appl. No.: 446,690

[22] Filed: Dec. 3, 1982

[30] Foreign Application Priority Data

Dec. 15, 1981 [JP] Japan ..... 56-202656

[51] Int. Cl.[4] ..... B26B 19/00

[52] U.S. Cl. ..... 30/195; 30/43.1; 30/201

[58] Field of Search ..... 30/216, 219, 195, 200, 30/201, 202, 241, 242, 43.1, 30, 31

[56] References Cited

U.S. PATENT DOCUMENTS

| | | | |
|---|---|---|---|
| 2,099,537 | 11/1937 | Schmitt | 30/43.1 |
| 2,292,364 | 8/1942 | Cromonic | 30/201 |
| 2,470,287 | 5/1949 | Carter | 30/195 X |
| 2,703,450 | 3/1955 | Larsen | 30/202 |
| 2,867,902 | 1/1959 | Groves | 30/200 |
| 3,531,862 | 10/1970 | Bender et al. | 30/201 |
| 3,651,570 | 3/1972 | Groves | 30/233 |

FOREIGN PATENT DOCUMENTS

| | | | |
|---|---|---|---|
| 2511960 | 3/1975 | Fed. Rep. of Germany . | |
| 54-58561 | 5/1979 | Japan . | |
| 143372 | 11/1979 | Japan | 30/201 |
| 1552752 | 9/1979 | United Kingdom . | |

*Primary Examiner*—Douglas D. Watts

*Attorney, Agent, or Firm*—Stevens, Davis, Miller & Mosher

[57] ABSTRACT

A hair cutter for thinning hair which includes a stationary blade, a movable blade, a comb member adjacent to either the movable blade or stationary blade, and a hair pressing member disposed on the side of either the stationary blade or movable blade where the comb member is not located. This arrangement permits hair to be thinned easily and accurately even when used by individuals lacking a barber's hair cutting skill.

19 Claims, 47 Drawing Figures

FIG. 1
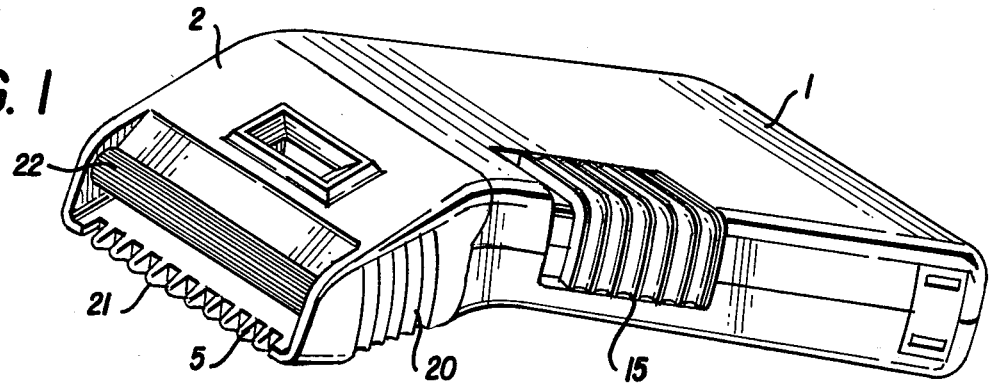
FIG. 2
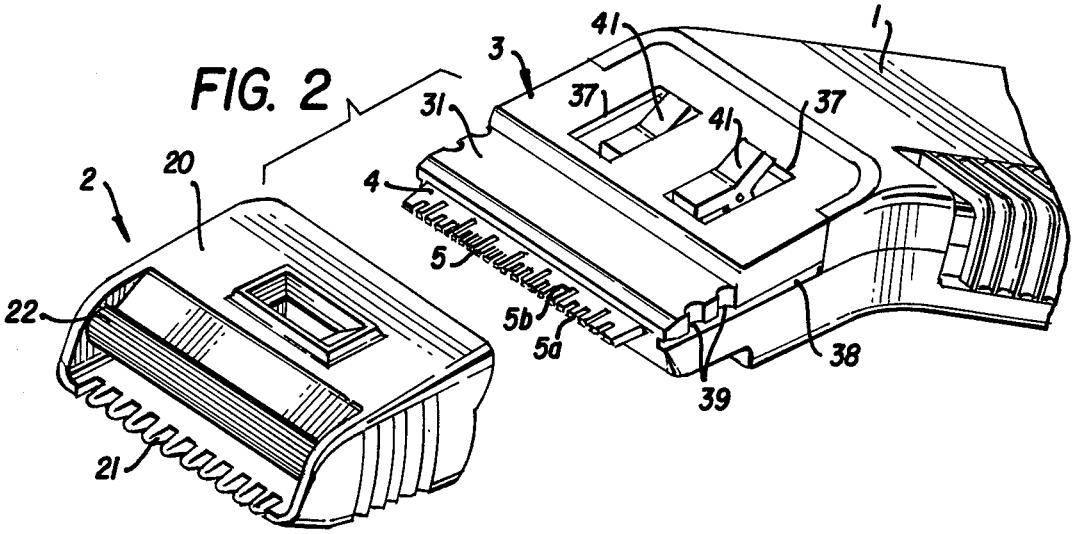
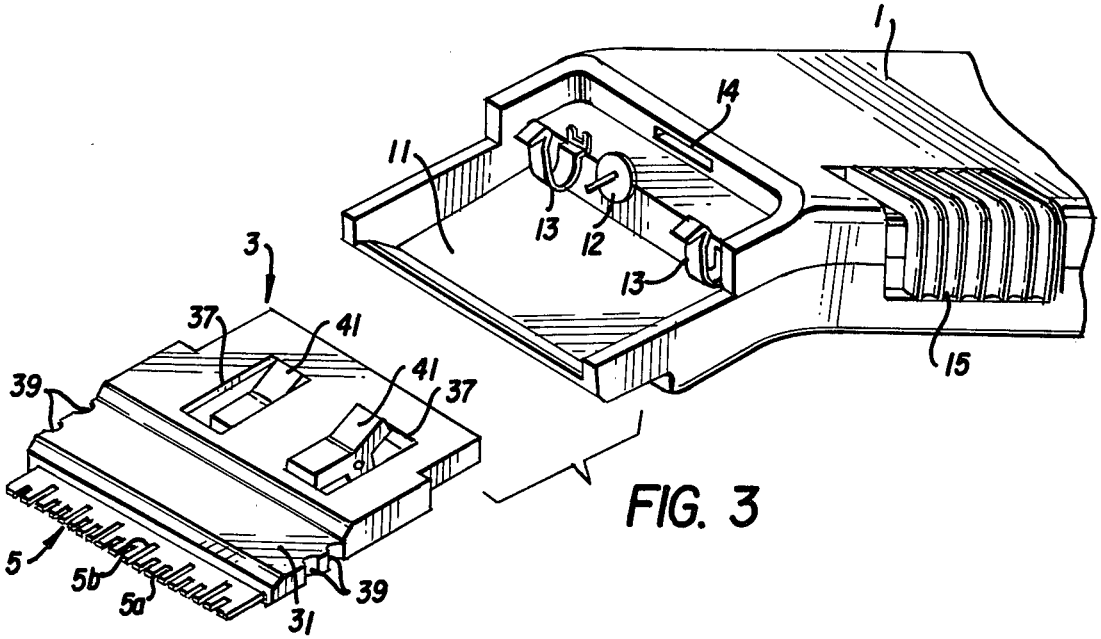
FIG. 3

FIG. 12
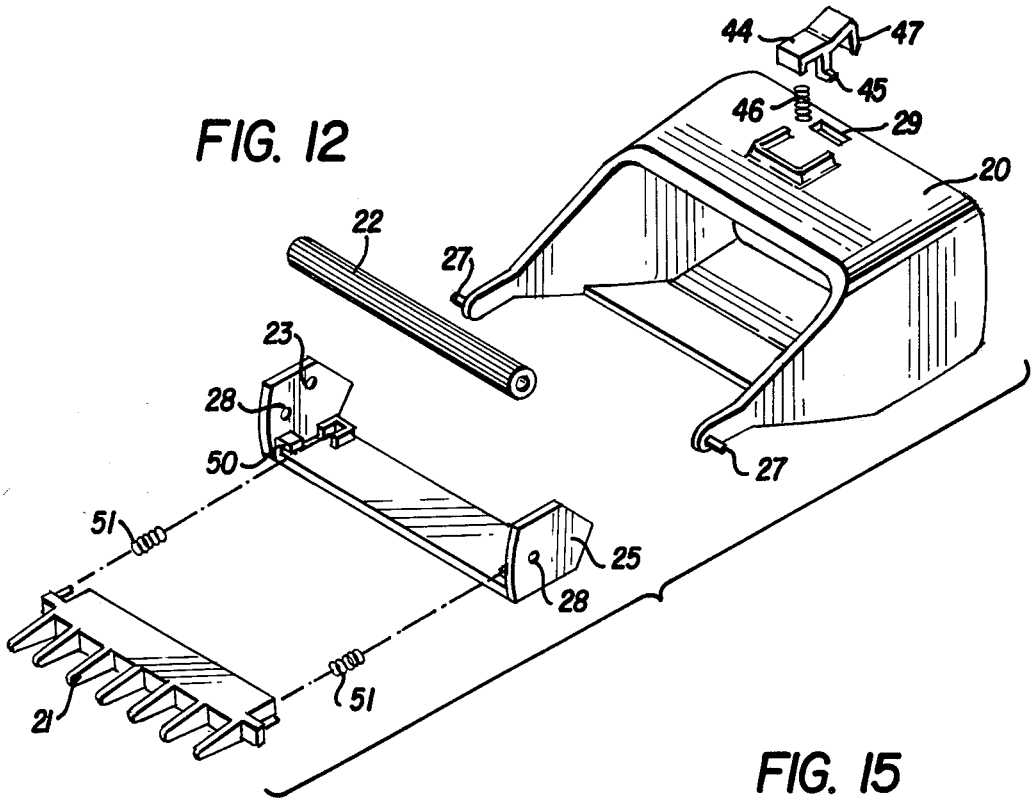
FIG. 14
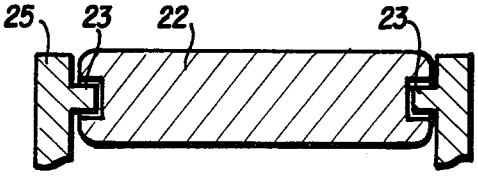
FIG. 15
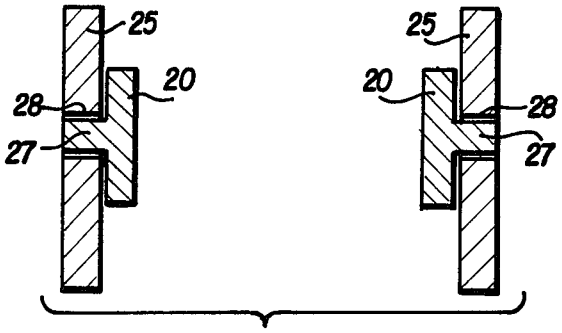
FIG. 20(a)
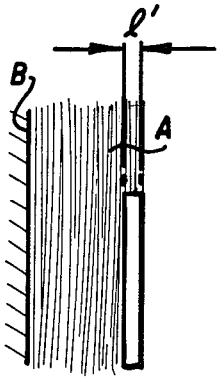
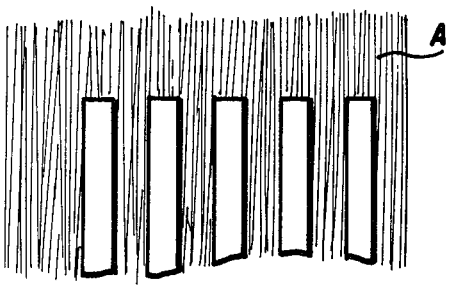
FIG. 20(b)

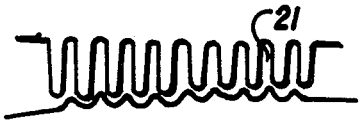
FIG. 27
FIG. 28(a)
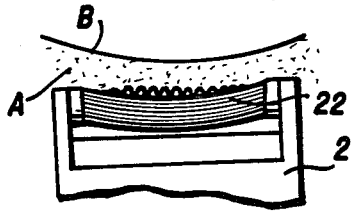
FIG. 28(b)
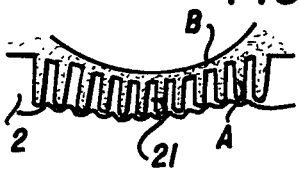
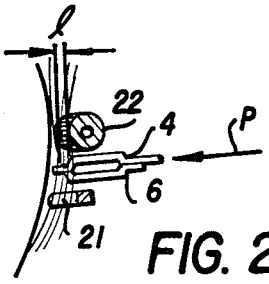
FIG. 29(a)
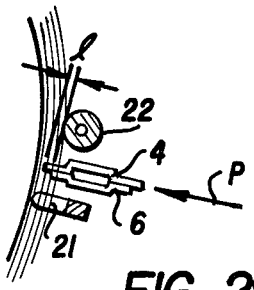
FIG. 29(b)
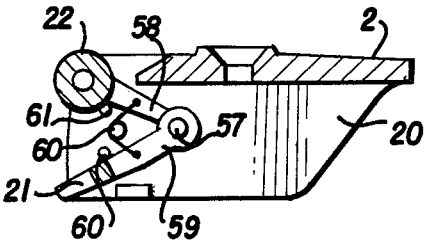
FIG. 30
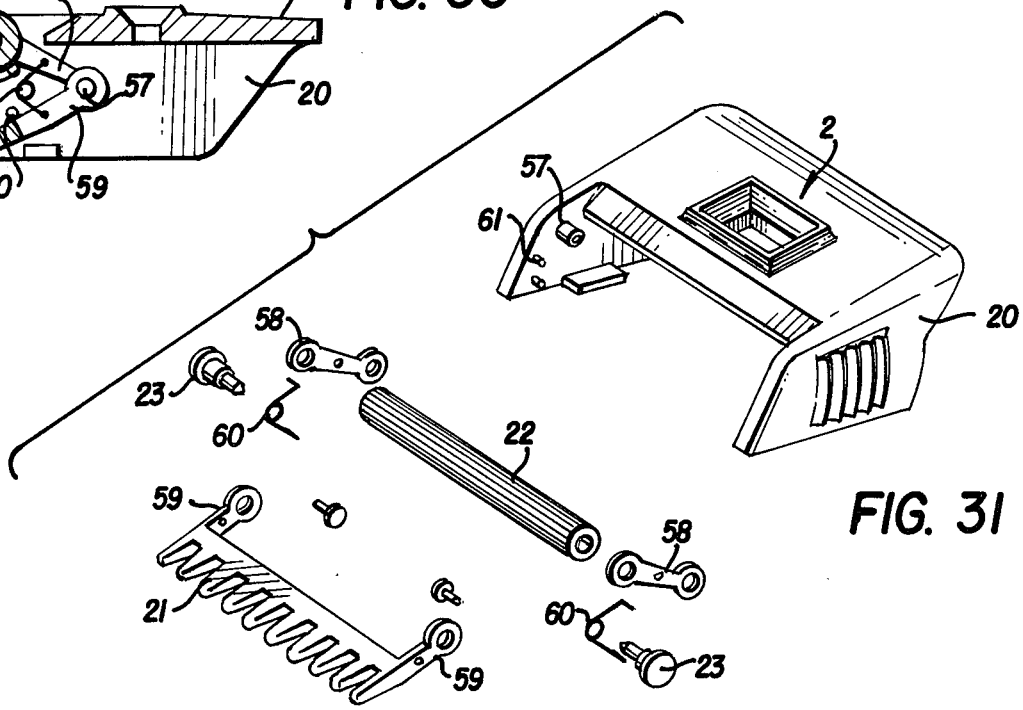
FIG. 31

HAIR CUTTER

BACKGROUND OF THE INVENTION

This invention relates to a hair cutter capable of thinning hair.

Hair cutters of the invention are provided with cutting recesses at appropriate intervals on the comb-like cutting blade of a stationary blade for thinning hair, Hair, guided into said recesses, is cut by a movable blade which is slidingly moved relatively to the stationary blade while being kept in contact with it. Hair is thereby cut along a cutting line at places where it contacts the spaced apart cutting recesses.

Hair thinning is a procedure which involves cutting hair in small quantities. When large quantities of hair are cut at one time with a stationary blade having a high density of cutting recesses, it is more difficult for the movable blade to operate than when hair is just being thinned. For this reason, individuals lacking a barber's skill in cutting hair prefer to thin hair rather than to cut it. Thinning, as described above, occasionally results in errors by the user. Consequently, there is a great demand for a hair cutter whose structure is capable of preventing user error due to a lack of knowledge or an inability to make manual adjustments.

Prior to the discovery of the present invention, the use of conventional hair cutters tended to cause errors. The correct way to use a hair cutter is to thin out hairs by stroking along a stream of hairs. Errors result if the cutter is pressed strongly against the hair without knowing the degree of manual adjustment or if the hair cutter is moved lightly without knowing the moving speed of the cutter. Such improper use of a hair cutter causes deep cutting in spots, producing a noticeable difference between the thinned and the non-thinned hair as well as conspicuous ridge-like lines.

SUMMARY OF THE INVENTION

This invention is drawn to a hair cutter which is easy to operate and permits the user to thin hair easily and without making errors.

BRIEF DESCRIPTION OF THE DRAWINGS

FIG. 1 is a perspective view of an embodiment of this invention;

FIG. 2 is an enlarged perspective view of FIG. 1 with the hair pressing block removed;

FIG. 3 is an enlarged perspective view of the main body with the blade block removed;

FIG. 12 is an exploded perspective view of a hair pressing block of the embodiment in FIG. 9;

FIG. 14 is a horizontal sectional view of the roller of the embodiment of FIG. 9;

FIG. 15 is a cross sectional view of the cover and the holder of the embodiment in FIG. 9;

FIGS. 20-(*a*) and -(*b*) are side and front views of thinned hairs;

FIG. 27 is a plan of a comb member of the hair pressing block of FIG. 25;

FIGS. 28-(*a*), -(*b*), 29-(*a*), and -(*b*) are explanatory views showing action of the roller and comb member of FIG. 25;

FIG. 30 is a vertical sectional view of still another hair pressing block;

FIG. 31 is an exploded perspective view of the hair pressing block in FIG. 30.

DETAILED DESCRIPTION OF THE DRAWINGS

Figure 4:
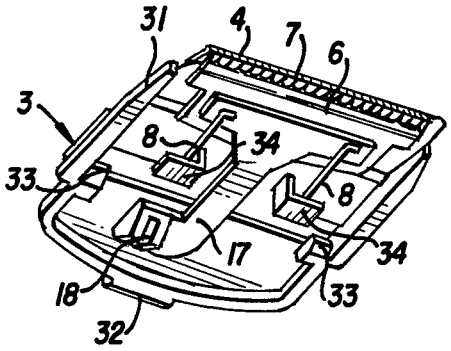
FIG. 4 is a perspective view showing the underside of the blade block.
Figure 5:
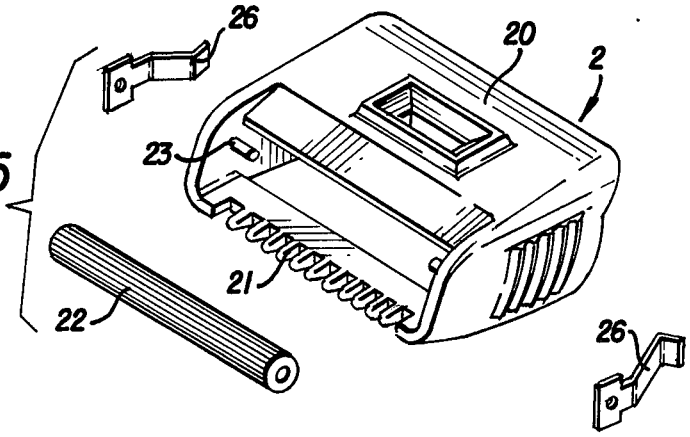
FIG. 5 is an exploded perspective view of a hair pressing block.
Figure 6:
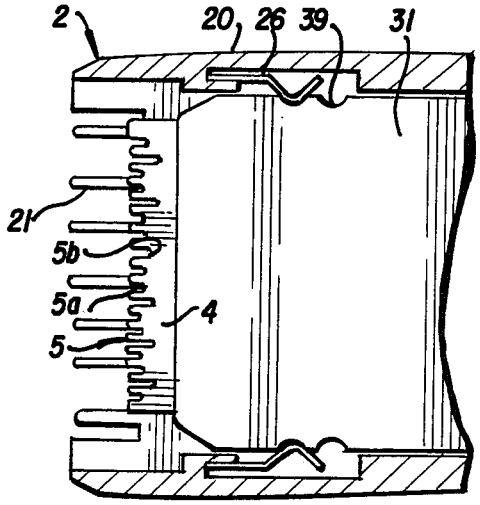
FIG. 6 is a horizontal sectional view of the hair pressing block.
Figure 7A:
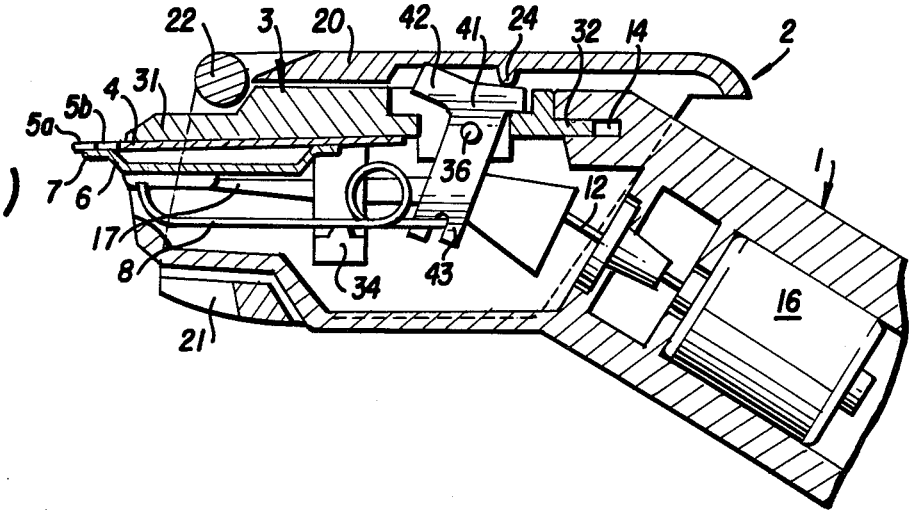
FIGS. 7-(*a*) and -(*b*) are vertical sectional views of the hair cutter of FIG. 1 arranged for hair cutting and hair thinning respectively.
Figure 7B:
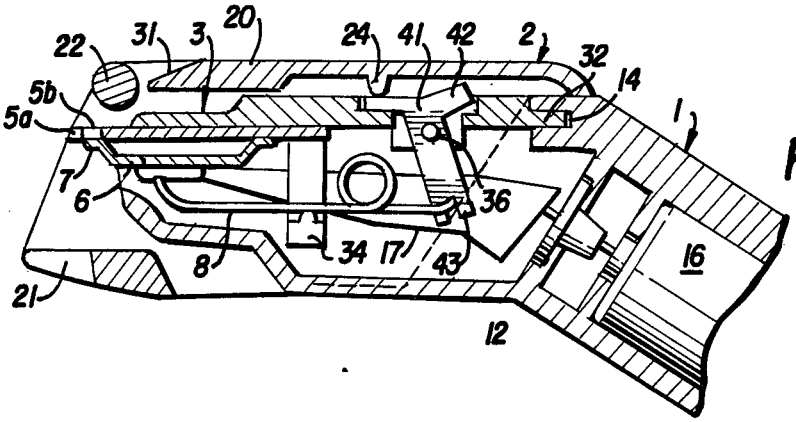

FIGS. 1 through 7 inclusive are views showing an embodiment of this invention, wherein a hair cutter is composed of a main body 1, blade block 3, and hair pressing block 2, wherein the latter two blocks are secured to the front upper part of the main body 1. The main body 1 is provided with a recess 11, to which the blade block 3 is secured, on the front upper part and a switch 15 on the side thereof. A projecting eccentric axis 12 is driven by the incorporated motor 16 in the rear part of the recess 11 and springs 13 are fixed on both sides of the rear part. Upon complete insertion of the projection 32 on the rear end of the blade block 3 into an engagement hole 14 of the main body 1, the fixing springs 13 are locked at the recesses of the engaging parts 33 whereby the blade block 3 is secured to the fitting recess 11 of the main body 1. The blade block 3 is composed of a setting base 31, a stationary blade 4, a movable blade 6 arranged on the front lower end of the setting base 31, a driving lever 17 with a movable blade 6 fixed to the front end thereof, a vertically extending long slit 18 with which said eccentric axis 12 engages on the rear end, a pair of pressing springs 8 for pressing the movable blade 6 toward the stationary one 4, and a pair of levers 41 for moving the movable blade 6 relatively to the stationary blade 4. The stationary blade 4 is fixed to the front lower surface of the setting base 31 while the movable blade 6 is reciprocated left and right by driving lever 17. The driving lever 17, which is arranged on the underside surface of the stationary blade, converts the revolution of the eccentric axis 12 into reciprocal movement in the slit 18. One end of each pressing spring 8 is adapted to engage with the front end of the driving lever 17 and the other end with a foot part 43 of the lever 41, wherein the spring is in the form of a coil as shown in FIG. 7. Each of the levers 41 is pivotally supported by the pin 36 so that the base of the foot part 43 may be turnable while the upper segment 42, which extends at an obtuse angle from the main part, projects upwardly above the top surface of the setting base 31 through a hole 37 of said base 31. At this time, the middle portion of the pressing spring 8 abuts a contact piece 34 projecting from the setting base 31 and a spring force pushing up the movable blade 6 toward the stationary blade 4 is generated around said contact piece as a fulcrum. The pressure for bringing the movable blade 6 and the stationary one 4 into contact with each other is maintained by this spring force.

The hair pressing block 2 includes a cover 20, a roller 22 rotatably supported by pins 23 at both ends thereof on the upper part of the front opening of the cover 20, and a comb member 21 formed integrally therewith on the lower end of the front opening of the cover 20 for hair combing. The hair pressing block 2 is fitted to the main body 1 by adapting projections (not shown) provided on both inner surfaces of the cover 20 to slidably engage with a recess 38 extending from front to back and formed between the lower side surface of the setting base 31 of the blade block 3 and the main body 1. By locking engagement of the tips of the springs 26, which are fitted to both inner surfaces of the cover 20, with stepwise front and rear recesses 39 as shown in FIG. 6, the hair pressing block is positioned in the course of the back-and-forth movement. In this way, the hair pressing block 2 fixed to the main body 1, as shown in FIG. 7-(*b*), positions the comb member 21 under the movable blade 4 when moved forward and adapts the roller 22 and comb member 21 to retreat from the position above the stationary blade 4 and the position under the movable blade 6, respectively, as shown in FIG. 7-(*a*).

The cutting recesses 5 aligned on the front edge of the stationary blade 4 comprise two kinds of recesses, deep ones 5*b* and shallow ones 5*a*, as shown in FIG. 6. For hair cutting, the movable blade 6 is moved forward relatively to the stationary blade 4 as shown in FIG. 7-(*a*) so that the blade edges 7 of the movable blade 6 are overlaid on all cutting recesses 5 of the stationary blade thus forming a cutting line along which the hair is cut. For thinning, as shown in FIG. 7(*b*), the blade edges 7 of the movable blade 6 are overlaid on only deep recesses 5*b*. The deep recesses 5*b* are properly apart from each other among cutting recesses 5, with the movable blade 6 is retreated. The backward and forward movement of the movable blade 6 is in association with that of the hair pressing block 2 in this embodiment. In other words, when the hair pressing block 2 is retreated, a pressing projection 24 provided inside the cover 20 of said block 2, as shown in FIG. 7-(*a*), presses the upper rear end of the upwardly extending part 42 of the lever 41 and turns the front end of the foot part 43 forward. This causes the movable blade 6 to move forward through the pressing spring 8 and the driving lever 17. When the hair pressing blade 2 is moved forward, the pressing projection 24 pushes the front upper end of the upwardly extending part 42 of the lever 41 and turns the end of the foot part 43 rearward. This causes movable blade 6 to retreat together with the driving lever 17 when pulled by the pressing spring 8. Since the position of the pressing spring 8 abutting on the contact piece 34 is simultaneously changed at this time, the spring force acting on the movable blade around the contact point of the contact piece as a fulcrum is varied, whereby contact pressure between the movable blade 6 and the stationary one 4 are made appropriate for ordinary cutting and thinning, respectively.

Thus, the retreat and advance of the hair pressing block 2 cause the advance of the movable blade 6 prepared for ordinary cutting and the retreat thereof for thinning, respectively. The position of the front edges of the comb member 21 and the roller 22 on the hair pressing block 2 advanced for thinning, as shown in FIG. 7-(*b*), is such that comb member 21 is arranged ahead of the roller 22, said roller 22 is positioned slightly behind the tip of the blade edge 7 of the movable blade 6, and the front edge of the comb member 21 is positioned ahead of the front edge of the stationary blade 4. The reason for such positioning as above will be described later.

Figure 8A:
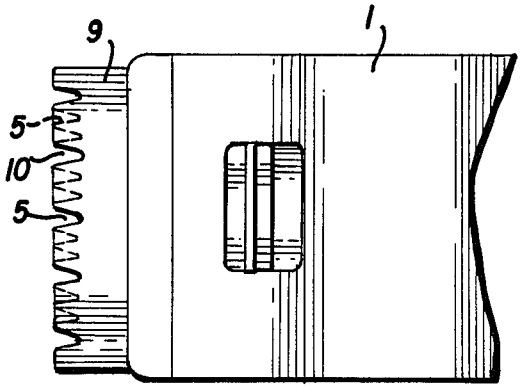
FIGS. 8-(*a*) and -(*b*) are a plan view of a second embodiment of a hair cutter main body and a broken sectional view of a hair pressing block attached thereto, respectively.
Figure 8B:
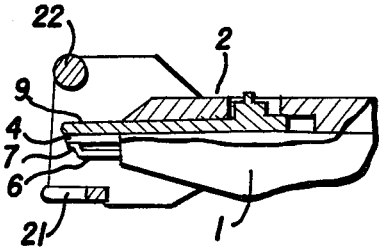
Figure 9:
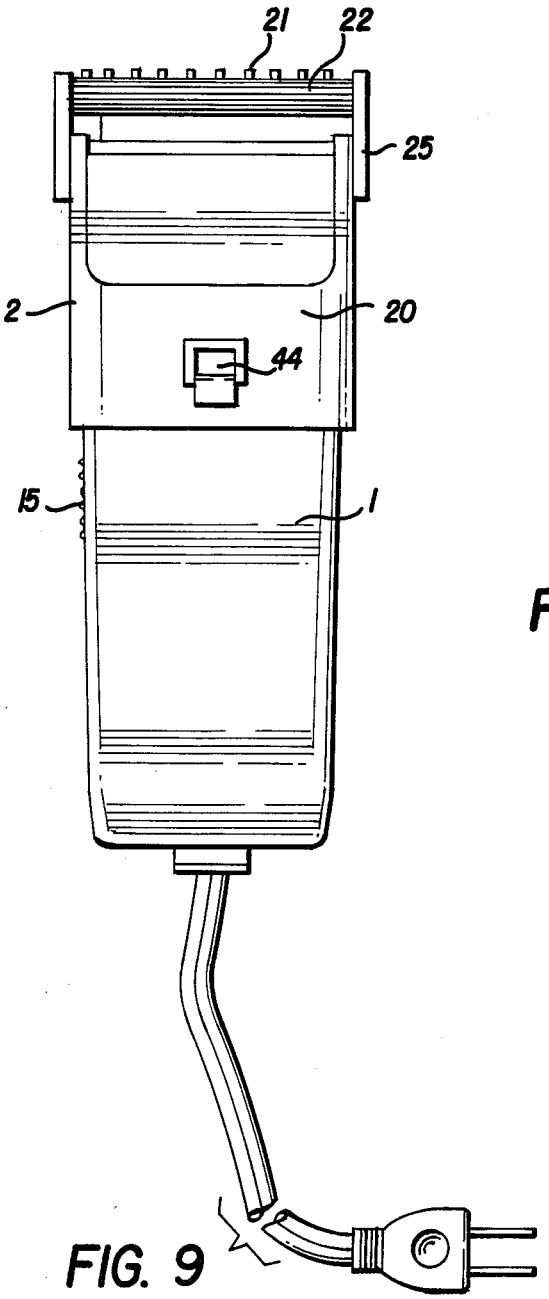
FIG. 9 is a plan of another embodiment of this invention.

A structure as shown in FIG. 8 shows another embodiment of a hair cutter capable of both ordinary cutting and thinning. In this structure, cutting recesses 5 of the stationary blade 4 are all dimensionally equal to each other and the movable blade 6 is incapable of back-and-forth movement so that the blade edge 7 is adapted to overlie all cutting recesses 5. Ordinary cutting is performed by means of blade edge 7 of the movable blade 6 and all of cutting recesses 5 of the stationary blade. On the other hand, thinning is achieved by forward shifting of an attachment 9, which is movable back and forth, and the subsequent overlaying thereof on the stationary blade 4. Thinning is thus performed by those cutting recesses 5 which are in agreement with cutouts 10 provided at appropriate intervals on the front edge of the attachment 9 and by the blade edge 7 of the movable blade 6, after closing cutting recesses 5 beside those recesses 5 which are in agreement with the cutouts 10 by means of the attachment 9. In this case, however, attachment 9, is interposed between roller 22 and comb member 21, in addition to the stationary blade 4 and the movable one 6. Therefore, the structure shown in FIGS. 1 through 7 is preferable for reducing the thickness of the cutter body.

Next, the other embodiments shown in FIGS. 9 through 17 will be described.

Figure 16:
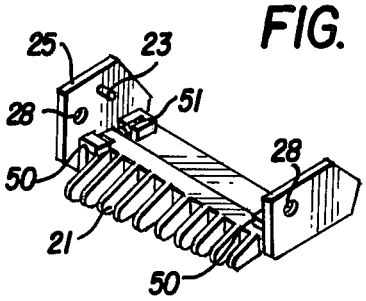
FIG. 16 is a perspective view of the holder and the comb member of the embodiment in FIG. 9 with the roller removed.
Figure 17:
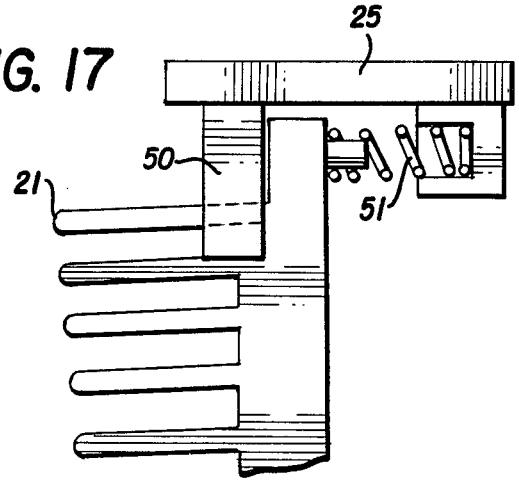
FIG. 17 is a partial plan view of the holder and comb member in FIG. 16.
Figure 32:
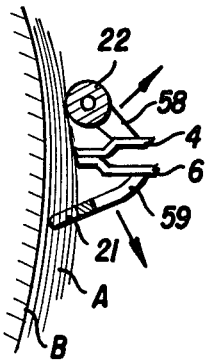
FIG. 32 is an explanatory view showing the action of hair pressing block in FIG. 30.
Figure 10:
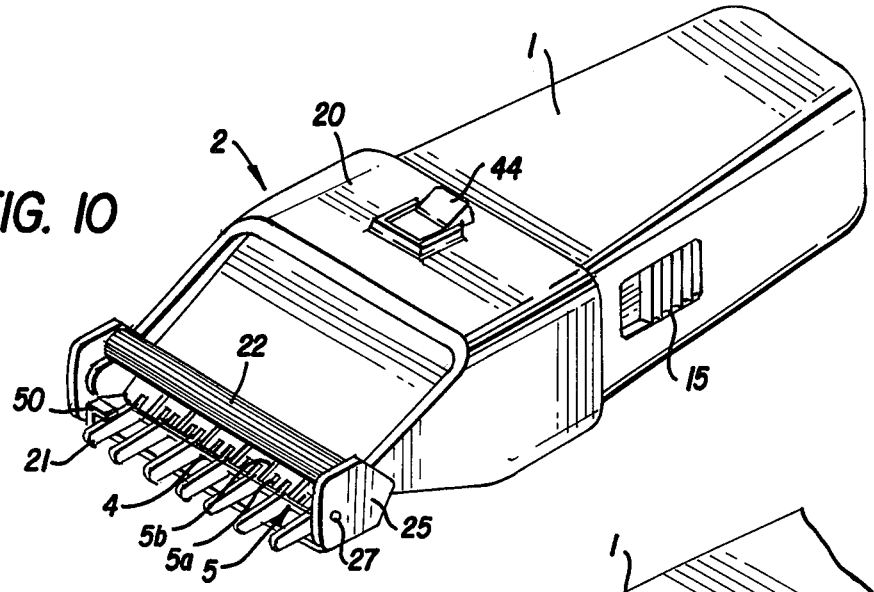
FIG. 10 is a perspective view of the embodiment of FIG. 9.
Figure 11:
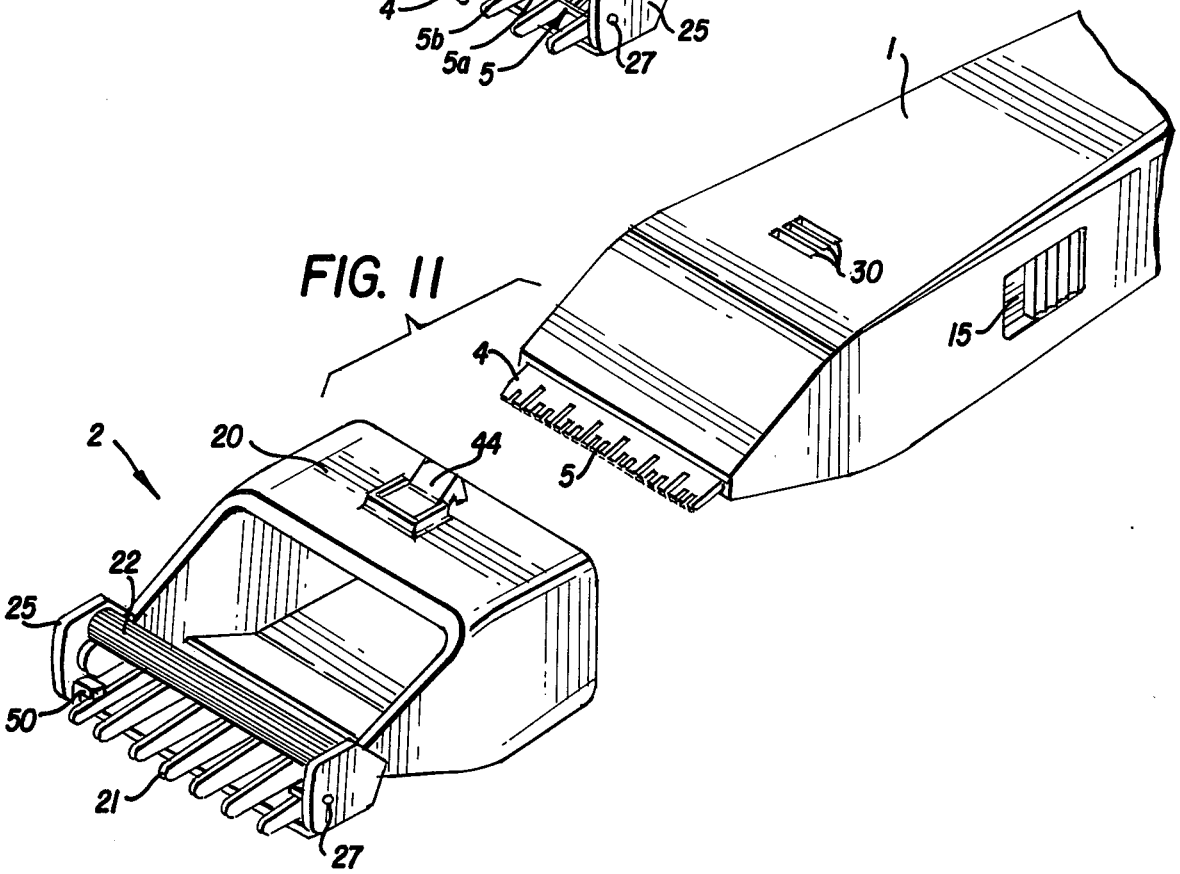
FIG. 11 is an enlarged perspective view of the embodiment of FIG. 9 with the hair pressing block removed.
Figure 13A:
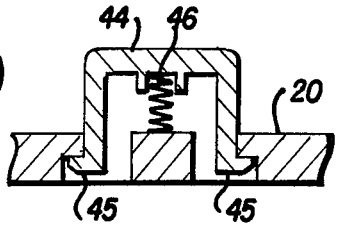
FIGS. 13-(*a*) and -(*b*) are a cross sectional and a longitudinal sectional views, respectively, of an operation lever of the embodiment of FIG. 9.
Figure 13B:
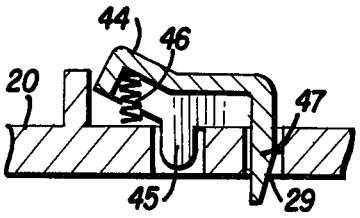

A hair pressing block 2 is composed of a cylindrical cover 20, a holder 25 adapted to be rotatable by engagement of pins 27 with holes 28 provided on the external surfaces of both sides forwardly extending from said cover 20, a roller 22, and a comb member 21 secured to the holder 25. As is apparent from FIGS. 12 and 13, an operating lever 44 is rotatably fixed to the top surface of the cover 20 with axes 45 interlocked with the inner surface of the cover 20. The operating lever 44 is further energized at one end thereof so that it is urged upward by a spring 46 arranged between this lever and the top surface of the cover 20 so that a hook part 47 of the other end thereof engages with any one of a plurality of engaging recesses 30 provided in succession from front to rear on the top of the main body 1 through a hole 29 in cover 20. That is to say, the cover 20 is movable from front to rear with respect to the main body 1 and can be fixed in a particular position by engagement of the hook part 47 with any of engaging recesses 30. The cover 20 is shifted back and forth with the operating lever 44 depressed at one end and with the hook part 47 released from the engaging recess 30. The roller 22 is rotatable, in the same way as in the previous embodiment, around pins 23 provided on both inner sides of the holder 25, and the comb member 21 is formed separately from rather than integrally with the holder 25 as shown in FIGS. 16 and 17. Comb member 21 is adapted to be slidable back and forth while being guided by the guide part 50 provided on both inner sides of the holder 25, and biased forward by a spring 51.

In a hair cutter of this type, the hair pressing block 2 is pushed forward and then removed from the cutter for ordinary cutting and is attached thereto for thinning.

Figure 18A:
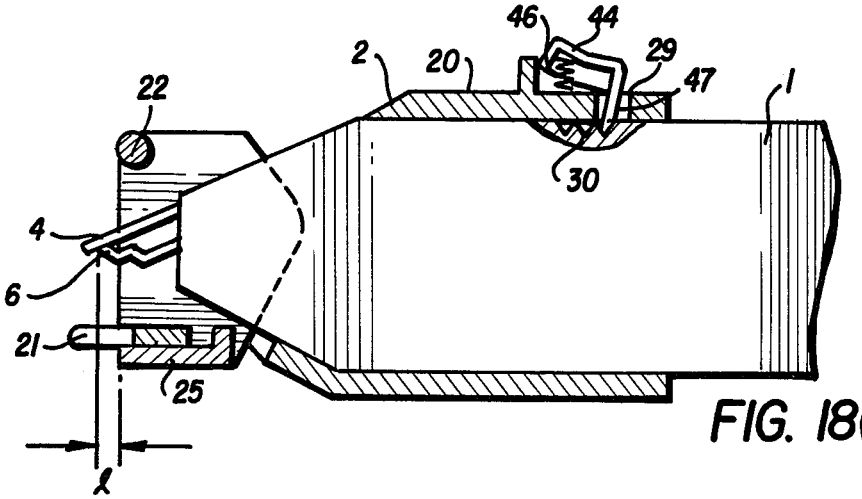
FIGS. 18-(*a*), -(*b*), and -(*c*) are front views showing sections of a hair pressing block of the embodiment in FIG. 9 locked in different positions on the main body.
Figure 18B:
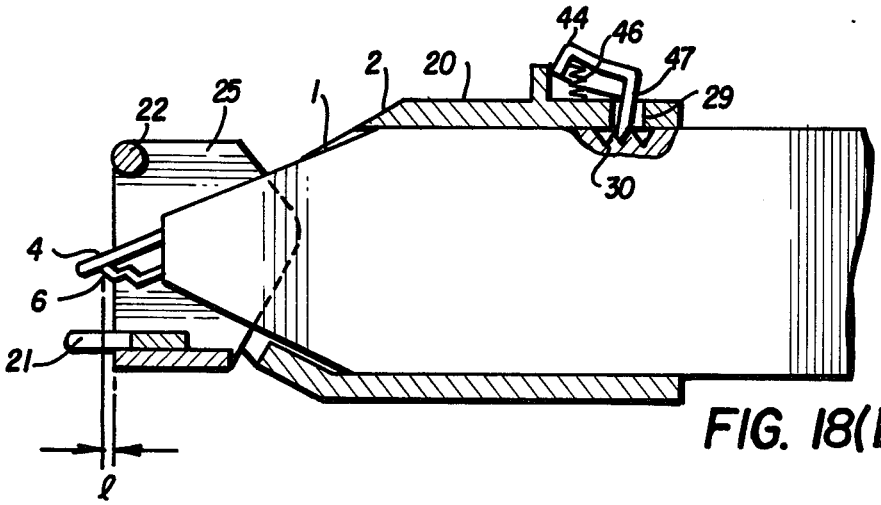
Figure 18C:
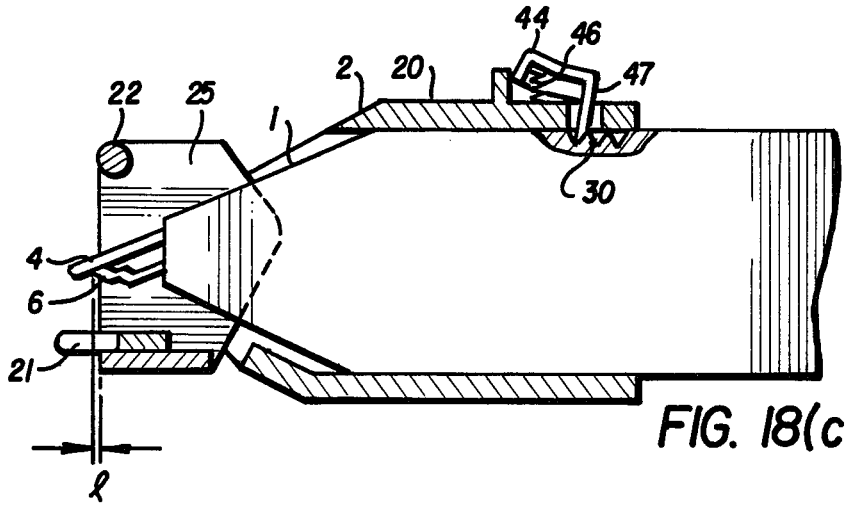

At the time of attachment, the comb member 21 lies ahead of the roller 22 and is positioned ahead of the front edge of the stationary blade 4, while the roller 22 is slightly behind the front edge of the movable blade 6 in the same way as in the previous embodiment. In the present embodiment, the hair pressing block 2 can be adjusted in the backward and forward direction in several steps (3 steps in the embodiment referred to). At any such step, the positional relation among the roller 22, movable blade 6, and comb member 21 is the same as described above and shown in FIG. 18.

Figure 19:
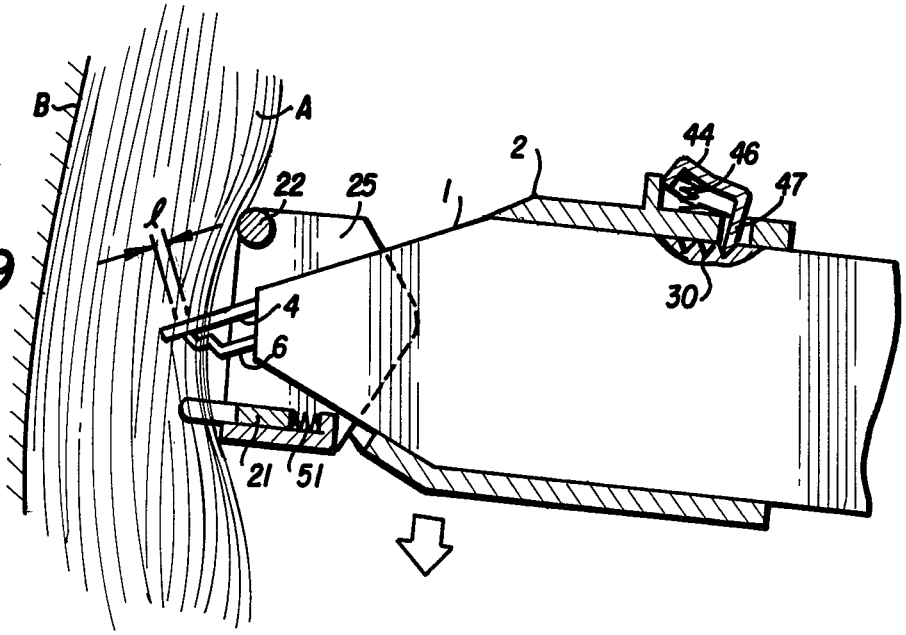
FIG. 19 is a broken front view of the hair pressing block in FIG. 18-(*a*), 18-(*b*), and 18-(*c*) in a state of use.

The action of comb member 21 and roller 22 on the hair pressing block 2 of the hair cutter in the structure described above during thinning will now be described. The reference characters A and B in FIG. 19 indicate the hair and the head skin, respectively. Hair thinning is performed when the blade of the hair cutter is brought into contact with the hair and moved downward along a stream of hairs. At this time, the tip part of the comb member 21 enters a bunch of hairs and when the cutter is moved downward, the comb member 21 combs the hair A which is to be cut. Thus, hair A in the upper layer only is evenly thinned to a fine finish with use of one hand. There is no need to carry a comb in one hand while operating the cutter with the other hand. Moreover, when the blade part is pressed strongly toward the hair A, the roller 22, as a hair pressing member, presses the hair A at a position slightly behind the blade part. Such hair pressing prevents a large quantity of hairs A from being guided into the cutting recesses 5 for thinning with stationary blade 4 and cutting with the cutting edge 7 of the movable blade 6. The hair A is cut in depth l which is equal to a distance between the front edge of the roller 22 and the blade edge 7 of the movable blade 6. The abovesaid depth l has no relation to the force used to press the blade part toward the hair A. As a result, no adjustment in operation is required and a constant, fixed cutting depth l is provided. Since the position of the hair pressing block 2 in the backward and forward direction is adjustable and the abovesaid distance l is variable, the cutting depth is also adjustable. The distance l is set according to the quantity of hairs so as to increase or decrease the cutting depth depending on whether the quantity of hair is large or small respectively. A cutter having comb member 21, independent from the cover 20 or the holder 25 of the hair pressing block 2 and biased forward, operates in the manner set forth below.

Figure 21A:
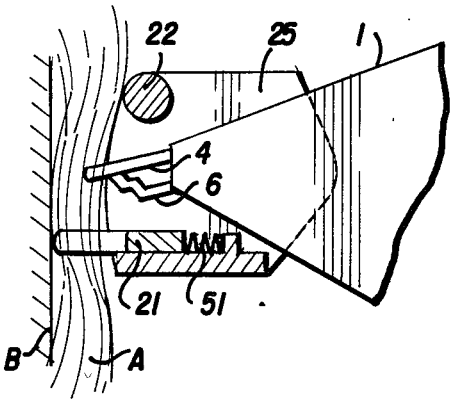
FIGS. 21-(*a*) and -(*b*) are broken front views showing the action of the biased comb member as the cutting blades are moved toward the head.
Figure 21B:
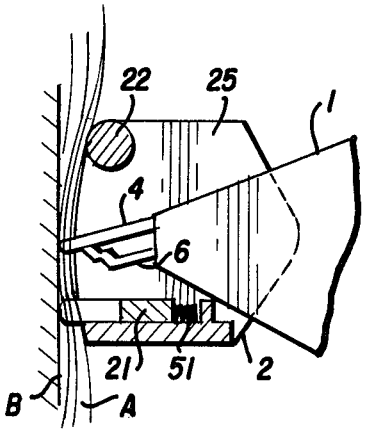
Figure 22:
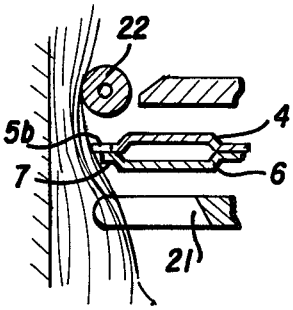
FIG. 22 is a sectional view of a main part showing the reason for setting the positional relation between the roller and the comb member in the backward and forward direction.

The depth of the hair varies between locations on the head and individuals. Thinning is readily performed without touching the edge of the comb member 21 to the head skin B at a place where hairs grow deep but the edge of the comb member 21 will abut the head skin B where hairs grow thinly. In the case of the extremely thin hair, hairs A are not guided into the cutting part. When the comb member 21 is moved backward and forward and biased forwardly, the front edge thereof abuts the head skin B and the distance from the front edge of the comb member 21 to the cutting part is shortened, as shown in FIG. 21, whereby the cutting part approaching the head skin B cuts hairs A. Since the distance l between the roller 22 and the edge of the cutting part is not varied, the cutting length is not varied and extreme thinning or no thinning by the backward and forward movement of the comb member 21 does not result. The comb member 21 is positioned ahead of the roller 22 as a hair pressing member because the comb member 21 acts to comb hairs A which are to be guided into the cutting recesses 5 while the roller 22 controls the quantity of hairs A to be guided as set forth above. This arrangement adapts each member to exhibit these functions more effectively. If the roller 22 is positioned ahead of the cutting part, there may be a case that hairs A are not sufficiently guided into the cutting recesses 5 of the stationary blade 4 and sufficient action of the comb member 21 upon hairs A would not result.

Figure 23:
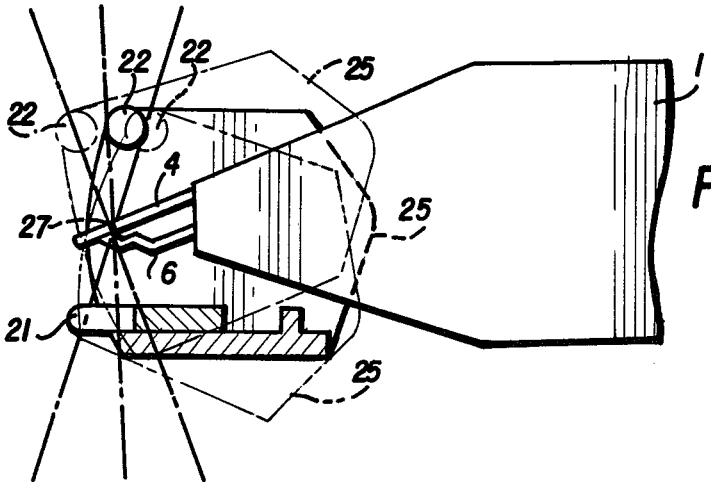
FIG. 23 is a broken front view showing the center of rotation of the holder while attached to the main body.
Figure 24:
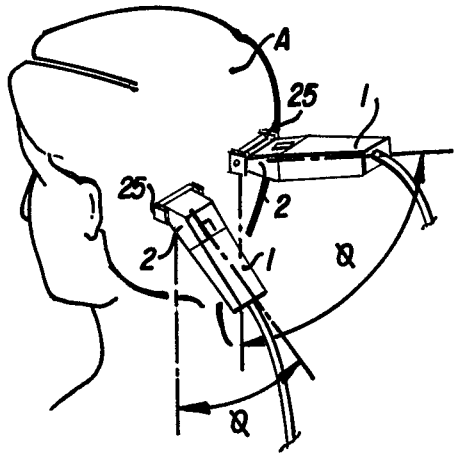
FIG. 24 is a perspective view showing an angle of application of the hair cutter to the hair and the action of the holder.

The action arising when the holder 25 of the hair pressing block 2 is rotatable relatively to the cover 20 will now be described. An angle between the main body 1 and the holder 25 is variable because the holder 25 is rotatable. Therefore, even when the angle at which the main body 1 is applied to the hair A is varied, as shown in FIG. 24, the roller 22 presses the hair A corresponding to operation of the hair cutter. Since the pin 27 of the cover 20, serves as an axis of rotation for the holder 25, as shown in FIG. 23, pin 27 is adapted to lie on the tip of the blade edge 7 of the movable blade set for thinning. Thus, the point to which the tip of the cutting part for thinning is extended and the positional relation among the roller 22, the tip of the cutting part, and comb member 21 is invariable regardless of an angle $\phi$ at which the main body 1 is applied to the hair A. The cutting depth, therefore, is also constant and the degree of thinning is kept constant even when the cutter is applied to the hair A at an angle other than specified.

Figure 25:
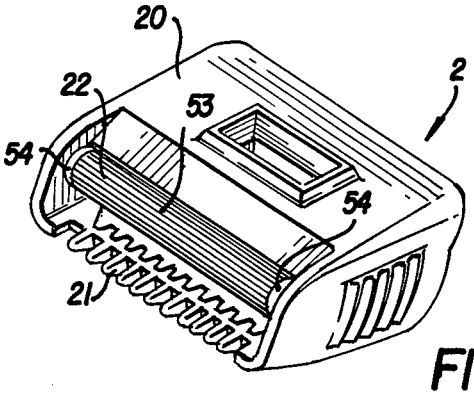
FIG. 25 is a perspective view of another example of a hair pressing block.
Figure 26A:
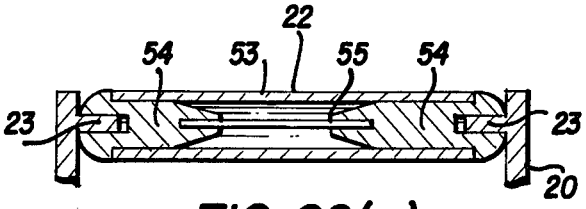
FIGS. 26-(*a*) and -(*b*) are respectively a cross sectional view and an enlarged perspective view of the roller of the hair pressing block of FIG. 25.
Figure 26B:
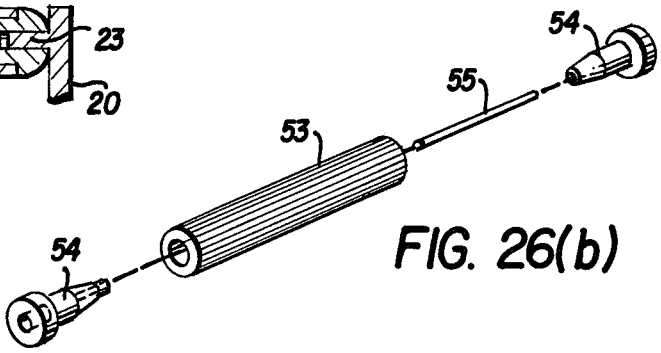

FIG. 25 shows a hair pressing block 2 provided with a resilient roller 22 and a resilient comb member 21. The roller 22 is composed of a tube 53 made of soft material such as rubber, as shown in FIG. 26, a pair of roller shafts 54 thrust into both ends of the tube 53 and rotatably fitted onto the pins 23 of the cover 20, a wire 55 for connecting both roller shafts 54 with each other, and a comb member 21 formed integrally with the cover 20 and made of resilient plastic to permit flexing in the backward and forward direction. The roller 22 and the comb member 21 are supported at both ends and are most easily bent at their middle portions. The roller 22 and the comb member 21, when strongly pressed to the hair A, bend rearwardly. As a result, the distance l from cutting recesses 5 and the tip of the blade edge 7 on movable blade 6 to the roller 22 is increased. This permits adjustment of the degree of thinning according to intensity with which the cutter is pressed to the hair A even if the position of the hair pressing block 2 is not adjusted in the backward and forward direction. Also, even when the angle at which the cutter is applied to the hair is varied, the variation in the abovesaid length l can be made small by flexing the roller 22 or the comb member 21 as shown in FIG. 29. Thus, the adjustment of pressing force P enables not only equalization of the degree of thinning regardless of the angle at which the cutter is applied to the hair but also adjustment of the degree of thinning.

The arrangement shown in FIG. 30 is capable of adjusting the degree of thinning. Arms 58 and side bars 59 extending from comb member 21 are adapted to be rotatable in the direction perpendicular to the front edges of the stationary blade 4 and the movable blade 6 and around supporting shafts 57 located on both inner sides of the cover 20. Each end of the roller 22 is pivotally supported by one end of the arm 58 through a pin 23. Springs 60 are provided between the arm 58 and the side bar 59 for energizing said arm and side bar so that an angle between said arm and side bar is reduced to some degree. This angle is, however, prevented from exceeding a certain value by stoppers 61 provided on both inner sides of the cover 20 and brought into contact with said arms 58 and side bars 59. When the roller 22 and/or the comb member 21 are pressed to the hair A, the roller 22 or the comb member 21 retreats while turning around the supporting shafts 57 and resisting the force of springs 60 so as to increase a distance l and cutting depth. In other words, the degree of thinning can be varied according to the intensity with which the cutter is pressed to the hair at a certain angle. Even when the angle of application varies slightly, variation in the degree of thinning can be compensated by adjusting the pressing force. This results in a fine finish for the hair in a short time, a soft touch of the cutter to the hair, and a comfortable experience for both the user and those having their hair cut. Also, the ability to adjust the hair cutter's degree of thinning enables fine cutting of short hairs growing near the neck.

A hair pressing block 2 fixed to the cutter and provided with a stationary blade 4 and a movable blade 6 which are available for thinning as well as ordinary cutting has been shown. A hair pressing member and a comb member 21 may, however, be provided directly on the main body 1 of a hair cutter used solely for thinning. Another example in which a hair pressing member and a comb member 21 are positioned near stationary blade 4 and the movable blade 5, respectively, has also been shown. An arrangement inversely different from the above may, however, be applicable. In conclusion, positioning a comb member 21 in front and a hair pressing member in the rear of the hair cutter during thinning satisfies the purposes of this invention.

As described above, a fine finish in hair cutting is obtained from the use of a hair cutter according to this invention because the hair cutter has a stationary comb-like blade provided with cutting recesses for thinning at the front edge thereof, a movable blade provided with a comb-like blade tip at the front edge thereof, a comb member located near any one of the stationary blade and the movable one, and a hair pressing member located near the other one of said two blades. These components are assembled into a hair cutter such that the front edges of the stationary blade and the movable blade are positioned between the hair pressing member and the comb member. The hair pressing member controls the quantity of hairs guided into the cutting recesses of the stationary blade for thinning regardless of the force with which the hair cutter is pressed to the hair and speed of moving the cutter. This prevents "over thinning" and permits a fine finish even when the degree of adjustment of the pressing force is unknown. A comb member is provided in addition to a hair pressing member. When the cutter is moved along a stream of hairs to be thinned, the comb member combs the hairs, guides hair into the cutting recesses of the stationary blade where they are cut, and untangles hairs. By only guiding hairs in the upper layer into the cutting recesses, a fine cutting finish is assured. There is also no need to carry a comb in one hand while operating the hair cutter with the other hand, which is difficult for the non-professional, because no comb other than the comb member is needed. The user can therefore concentrate on operating the hair cutter and thus achieve a fine cutting finish.

What is claimed is:

1. A hair cutter comprising:

a stationary blade having a leading edge with comb-like cutting teeth with recesses for hair thinning;

a movable blade in parallel contacting relationship to said stationary blade and having comb-like cutting teeth at its leading edge to define a cutting plane;

an elongated comb member disposed substantially parallel to and on one side of said cutting plane;

an elongated hair pressing member disposed substantially parallel to and on the other side of said cutting plane so that the leading edges of said stationary blade and said movable blade are located between said hair pressing member and said comb member; the comb-like cutting teeth of said stationary blade having cutting recesses in small and large depths at its leading edge and means (a) to move said movable blade backward and foward along said cutting plane in relation to said stationary blade to place the movable blade in operative cutting position in relation to either all of the cutting recesses of said stationary blade or only those recesses having large depth; and to (b) move at least one of said comb member and said hair pressing member toward and away from a second plane generally perpendicular to said cutting plane.

2. A hair cutter as set forth in claim 1, wherein said comb member is positioned ahead of said hair pressing member.

3. A hair cutter as set forth in claim 1, wherein at least one of said hair pressing member and said comb member is resilient.

4. A hair cutter as set forth in claim 1, wherein said hair pressing member is a roller rotatable about an axis parallel with the leading edges of said stationary blade and said movable blade.

5. A hair cutter as set forth in claim 1, wherein said hair pressing member is on the same side as said stationary blade and said comb member is on the same side as said movable blade.

6. A hair cutter as set forth in claim 1, wherein at least one of said comb member and said hair pressing member is positionally adjustable in the backward and forward direction with respect to said stationary and said movable blades.

7. A hair cutter as set forth in claim 6, wherein said comb member and said hair pressing member are mounted on a hair pressing block with interconnecting means whereby said comb member and said hair pressing member may be adjusted together in the backward and forward directions relative to the main body of said hair cutter.

8. A hair cutter as set forth in claim 7, further comprising:

an adjustable attachment positioned on top of said stationary blade, said adjustable attachment being operable to slide said hair pressing block in the backward and forward directions without adjusting the position of said movable blade.

9. A hair cutter as set forth in claim 7, further comprising:

a lever having a first portion engageable with said hair pressing block; and a connector coupling a second portion of said lever and said movable blade, whereby said movable blade is movable in the backward and forward directions relative to the main body of said hair cutter and is adapted to move in association with but in the opposite direction of said hair pressing block.

10. A hair cutter as set forth in claim 9, wherein said lever is operable between two positions in which said movable blade may be positioned in either a hair cutting position or a hair thinning position.

11. A hair cutter as set forth in claim 10, wherein said hair pressing block is engaged with said lever whereby when said block is moved backward, said movable blade moves forward relative to said main body to said hair cutting position and when said hair pressing block is moved forward, said movable block moves backward relative to said main body to said hair thinning position.

12. A hair cutter as set forth in claim 7, including means to lock said hair pressing block in a plurality of positions relative to the main body of said hair cutter.

13. A hair cutter as set forth in claim 12, further comprising:

a locking lever on said hair pressing block for locking the hair pressing block to said main body in any one of said plurality of positions.

14. A hair cutter as set forth in claim 13, wherein said locking lever is rotatable to engage any one of a plurality of recesses on the main body thereby locking the hair pressing block to said main body.

15. A hair cutter as set forth in claim 12, further comprising:

a holder extending forwardly from said hair pressing block and connecting said comb member and said hair pressing member to said hair pressing block.

16. A hair cutter as set forth in claim 15, wherein said holder is rotatable about an axis parallel to the leading edges of said stationary and movable blades.

17. A hair cutter as set forth in claim 16, further comprising:

a first spring means extending between the holder and said comb member for urging said comb member in the forward direction.

18. A hair cutter as set forth in claim 7, further comprising:

a second spring means extending between said comb member and said hair pressing member to urge said comb member and said hair pressing member towards each other; and stopper means to limit the extent to which said comb member and said hair pressing member are urged towards each other.

19. A hair cutter as set forth in claim 18, wherein said comb member and said hair pressing member are pivotally mounted to rotate around a common axis parallel to the front edges of said stationary and said movable blades.

* * * * *